US010898950B2

(12) United States Patent
Saito et al.

(10) Patent No.: US 10,898,950 B2
(45) Date of Patent: Jan. 26, 2021

(54) DUST CORE, ELECTROMAGNETIC COMPONENT AND METHOD FOR MANUFACTURING DUST CORE

(71) Applicants: Sumitomo Electric Industries, Ltd., Osaka (JP); Sumitomo Electric Sintered Alloy, Ltd., Takahashi (JP)

(72) Inventors: Tatsuya Saito, Itami (JP); Tomoyuki Ueno, Itami (JP); Asako Watanabe, Itami (JP); Hijiri Tsuruta, Itami (JP)

(73) Assignees: Sumitomo Electric Industries, Ltd., Osaka (JP); Sumitomo Electric Sintered Alloy, Ltd., Takahashi (JP)

( * ) Notice: Subject to any disclaimer, the term of this patent is extended or adjusted under 35 U.S.C. 154(b) by 343 days.

(21) Appl. No.: 15/743,507

(22) PCT Filed: Jul. 15, 2016

(86) PCT No.: PCT/JP2016/071093
§ 371 (c)(1),
(2) Date: Jan. 10, 2018

(87) PCT Pub. No.: WO2017/018264
PCT Pub. Date: Feb. 2, 2017

(65) Prior Publication Data

US 2018/0200787 A1 Jul. 19, 2018

(30) Foreign Application Priority Data

Jul. 27, 2015 (JP) ..... 2015-148160

(51) Int. Cl.
*B22F 1/00* (2006.01)
*B22F 1/02* (2006.01)
(Continued)

(52) U.S. Cl.
CPC ..... *B22F 1/0007* (2013.01); *B22F 1/00* (2013.01); *B22F 1/02* (2013.01); *B22F 3/00* (2013.01);
(Continued)

(58) Field of Classification Search
CPC ..... H01F 1/24
See application file for complete search history.

(56) References Cited

U.S. PATENT DOCUMENTS

2009/0116990 A1* 5/2009 Unoki ..... H01F 1/33 419/19
2012/0082844 A1 4/2012 Takahashi et al.

FOREIGN PATENT DOCUMENTS

CN 101545070 A 9/2009
CN 101927344 A 12/2010
(Continued)

OTHER PUBLICATIONS

Machine translation of Yoshihisa, JP2002313620 (Year: 2002).*

*Primary Examiner* — Ian A Rummel
(74) *Attorney, Agent, or Firm* — Baker Botts LLP; Michael A. Sartori

(57) ABSTRACT

A dust core includes: a plurality of soft magnetic particles composed of an iron-based material; an insulating layer including a coating layer that is composed mainly of a phosphate and covers the surface of the soft magnetic particles; and insulating pieces containing a constituent material of the insulating layer, each of the insulating pieces being surrounded by at least three mutually adjacent ones of the soft magnetic particles while separated from the insulating layer.

10 Claims, 2 Drawing Sheets

(51) Int. Cl.

| | |
|---|---|
| ***B22F 3/02*** | (2006.01) |
| ***B22F 3/24*** | (2006.01) |
| ***H01F 1/24*** | (2006.01) |
| ***H01F 27/255*** | (2006.01) |
| ***H01F 41/02*** | (2006.01) |
| ***B22F 3/00*** | (2006.01) |
| *H01F 3/08* | (2006.01) |

(52) U.S. Cl.

CPC ..... *B22F 3/02* (2013.01); *B22F 3/24* (2013.01); *H01F 1/24* (2013.01); *H01F 27/255* (2013.01); *H01F 41/02* (2013.01); *H01F 41/0246* (2013.01); *B22F 2003/248* (2013.01); *B22F 2301/35* (2013.01); *H01F 3/08* (2013.01)

(56) References Cited

FOREIGN PATENT DOCUMENTS

| | | | |
|---|---|---|---|
| CN | 103959405 | A | 7/2014 |
| EP | 1739694 | A1 | 1/2007 |
| EP | 2105936 | A1 | 9/2009 |
| JP | 2002-313620 | A | 10/2002 |
| JP | 2009-228107 | A | 10/2009 |
| JP | 2012-107330 | A | 6/2012 |
| JP | 2014-019929 | A | 2/2014 |

* cited by examiner

DUST CORE, ELECTROMAGNETIC COMPONENT AND METHOD FOR MANUFACTURING DUST CORE

TECHNICAL FIELD

The present invention relates to a dust core, to an electromagnetic component, and to a method for manufacturing a dust core.

The present application claims priority from Japanese Patent Application No. 2015-148160 filed on Jul. 27, 2015, the entire contents of which are incorporated herein by reference.

BACKGROUND ART

An electromagnetic component including a coil formed by winding a wire and a magnetic core around which the coil is disposed and which forms a closed magnetic circuit is used as a component included in an energy conversion circuit such as a switching power supply or a DC/DC convertor.

In some cases, a dust core manufactured using a powder composed of a soft magnetic material is used as the magnetic core. The dust core is manufactured, for example, through a preparation step, a coating step, a mixing step, a pressurization step, and then a heat treatment step described below (PTL 1).

Preparation step: Soft magnetic particles are prepared.

Coating step: The surface of the soft magnetic particles is coated with an insulating layer.

Mixing step: A coated soft magnetic powder composed of the soft magnetic particles coated with the insulating layer is mixed with a resin powder (lubricant) for molding to form a powder mixture.

Pressurization step: The powder mixture is pressurized to produce a compact.

Heat treatment step: The compact is subjected to heat treatment to remove strain introduced into the soft magnetic particles in the pressurization step.

CITATION LIST

Patent Literature

PTL 1: Japanese Unexamined Patent Application Publication No. 2012-107330

SUMMARY OF INVENTION

The dust core of the present disclosure comprises:

a plurality of soft magnetic particles composed of an iron-based material;

an insulating layer including a coating layer that is composed mainly of a phosphate and covers the surface of the soft magnetic parades; and insulating pieces containing a constituent material of the insulating layer, each of the insulating pieces being surrounded by at least three mutually adjacent ones of the soft magnetic particles while separated from the insulating layer.

The electromagnetic component of the present disclosure comprises: a coil formed by winding a wire; and a magnetic core around which the coil is disposed, wherein at least part of the magnetic core is the dust core of the present disclosure.

The dust core manufacturing method of the present disclosure comprises:

a preparation step of preparing a coated soft magnetic powder including a plurality of coated soft magnetic particles prepared by coating the outer circumferential surface of soft magnetic particles composed of an iron-based material with an insulating layer including a coating layer composed mainly of a phosphate;

a powder heat treatment step of subjecting the coated soft magnetic powder to heat treatment to produce a heat-treated coated powder in which the insulating layer has been partially crystallized;

a molding step of subjecting the heat-treated coated powder to compression molding to produce a compact; and a compact heat treatment step of subjecting the compact to heat treatment to remove strain introduced into the soft magnetic particles in the molding step.

DESCRIPTION OF EMBODIMENTS

Figure 1:
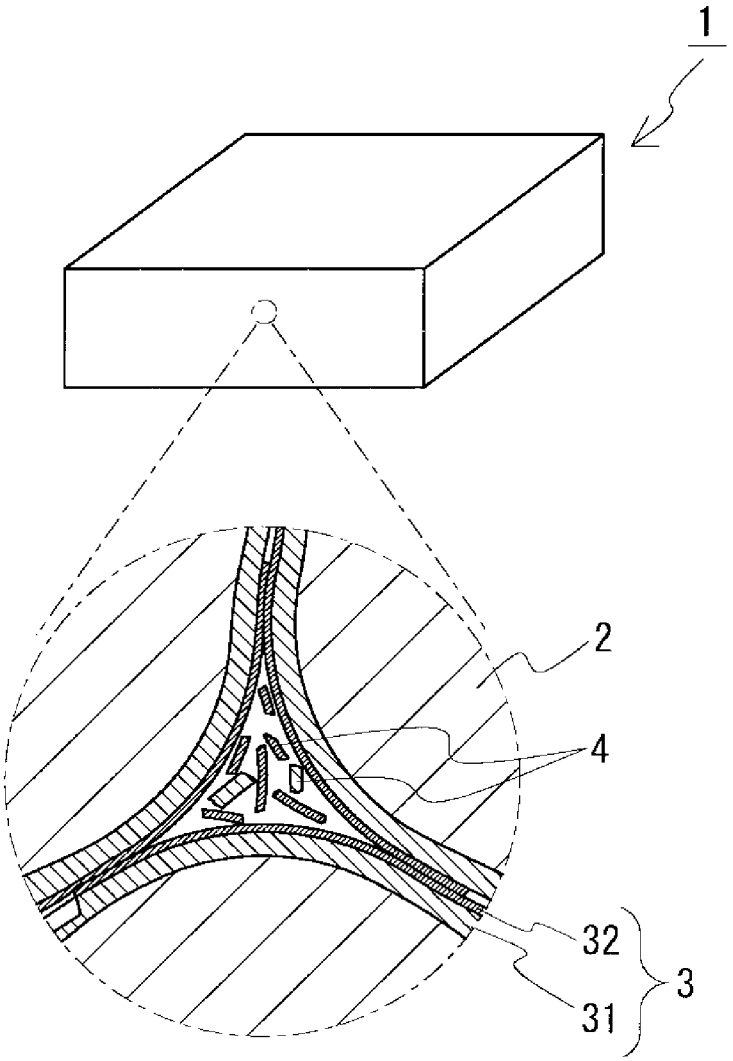
FIG. 1 is a schematic diagram showing the internal structure of a dust core according to an embodiment.

Problems to be Solved by the Disclosure

There is a need for a dust core with higher density and lower loss. With the conventional dust core manufacturing method, the loss in the dust core can be reduced to some extent, but there is a limit to the increase in the density of the dust core. For example, it is conceivable that, to achieve an increase in the density of the dust core, the pressurization step may be performed with the powder mixture heated. In this case, the deformability of the soft magnetic particles increases, and this may contribute to the increase in the density. However, eddy-current loss increases, and this results in an increase in loss.

One object is to provide a dust core with high density and low loss.

Another object is to provide an electromagnetic component comprising the dust core.

Yet another object is to provide a dust core manufacturing method with which a dust core with high density and low loss can be obtained.

Advantageous Effects of the Disclosure

The dust core of the present disclosure has high density and low loss.

The electromagnetic component of the present disclosure is excellent in magnetic properties.

With the dust core manufacturing method of the present disclosure, a dust core with high density and low loss can be manufactured.

<<Description of Embodiments of the Present Invention>>

To manufacture a dust core that combines high density with low loss, the present inventors have conducted extensive studies on its manufacturing method. As a result, the inventors have found that a dust core that combines high density with low loss can be manufactured by subjecting coated soft magnetic particles prepared by coating the outer circumferential surface of soft magnetic particles with an insulating layer to specific heat treatment before compression molding, as described later in Test Examples. In particular, the inventors have found that a dust core that combines high density with low loss can be manufactured even by room temperature molding by which high density has been difficult to achieve and even by molding under heating by which low loss has been difficult to achieve. The present invention is based on the above findings. First, embodiments of the present invention will be enumerated and described.

(1) A dust core according to one aspect of the present invention comprises;

a plurality of soft magnetic particles composed of an iron-based material;

an insulating layer including a coating layer that is composed mainly of a phosphate and covers the surface of the soft magnetic particles; and insulating pieces containing a constituent material of the insulating layer, each of the insulating pieces being surrounded by at least three mutually adjacent ones of the soft magnetic particles while separated from the insulating layer.

With the above dust core, high density and low loss are achieved. This dust core is manufactured using a heat-treated coated powder prepared by subjecting coated soft magnetic particles to heat treatment. Therefore, strain in the coated soft magnetic particles is removed, and the particles are softened and easily deformable during molding, so that the density can be easily increased. It is conceivable that the insulating pieces containing the constituent material of the insulating layer and each surrounded by at least three mutually adjacent ones of the soft magnetic particles may be formed when the heat-treated coated powder is subjected to compression molding. Specifically, parts of the surface of the insulating layer are peeled off to the extent that the surface of the soft magnetic particles is not exposed, and the peeled parts are separated from the insulating layer and moved. The insulating pieces function as a lubricant for the particles of the heat-treated coated powder during molding and reduce the pressure on the non-peeled insulating layer. The soft magnetic particles are not exposed from the insulating layer, and breakage of the non-peeled insulating layer can be prevented, so that the insulation between the particles is improved.

(2) In one mode of the dust core, the insulating pieces are composed mainly of iron phosphate containing iron in an amount of from 20 atom % to 37 atom % inclusive.

In the above dust core, the insulating pieces included contain iron in an amount within the above range. This easily allows the dust core to have high density and low loss.

(3) In another mode of the dust core, the coating layer has an average thickness of from 30 nm to 120 nm inclusive.

When the thickness of the coating layer is 30 nm or more, insulation between the soft magnetic particles can be easily improved. The coating layer having a thickness of 120 nm or less easily allows the dust core to have high density.

(4) In another mode of the dust core, the insulating layer further includes an outer layer formed outward of the coating layer, and the outer layer is composed mainly of O and one element selected from Si, Mg, Ti, and Al.

In the above dust core, high density and low loss are easily achieved simultaneously. Like the coating layer, the outer layer is peeled off during the compression molding and forms insulating pieces separated from the insulating layer. When the outer layer is provided, the degree of peeling of the coating layer during compression molding is less than that when only the coating layer is provided. The coating layer is substantially prevented from peeling off to the extent that the soft magnetic particles are exposed, so that the insulation between the soft magnetic particles can be easily improved. Therefore, even when the molding is performed at a higher pressure to increase the density, the insulation between the soft magnetic particles is maintained, and this easily allows the dust core to have higher density and lower loss. When the outer layer is composed mainly of O and one element selected from Si, Mg, Ti, and Al, the adhesion between the non-peeled outer layer and the coating layer composed mainly of the phosphate can be easily improved.

(5) In another mode of the dust core in which the insulating layer includes the outer layer, the outer layer has an average thickness of from 10 nm to 100 nm inclusive.

When the thickness of the outer layer is 10 nm or more, the insulation between the soft magnetic particles can be easily improved. When the thickness of the outer layer is 100 nm or less, the density of the dust core can be easily increased.

(6) In another mode of the dust core, the material of the soft magnetic particles is pure iron.

Since pure iron is superior to an iron alloy in terms of magnetic permeability, magnetic flux density, etc., the above dust core is more likely to have excellent magnetic properties.

(7) In another mode of the dust core, the coating layer is composed mainly of iron phosphate containing iron in an amount of from 22 atom % to 40 atom % inclusive.

In the above dust core, the coating layer provided contains iron in an amount within the above range. This easily allows the dust core to have high density and low loss.

(8) In another mode of the dust core, an inner portion of the dust core has an electrical resistivity of $5\times10^{-1}$ Ω·cm or more.

When the electrical resistivity is $5\times10^{-1}$ Ω·cm or more, eddy-current loss can be reduced, so that an electromagnetic component excellent in magnetic properties can be easily constructed.

(9) An electromagnetic component according to another aspect of the present invention is an electromagnetic component comprising:

a coil formed by winding a wire; and a magnetic core around which the coil is disposed, wherein at least part of the magnetic core is the dust core according to any one of (1) to (8) above.

In the above electromagnetic component, the above-described dust core with high density and high resistance is provided. Therefore, excellent magnetic properties are obtained.

(10) A dust core manufacturing method according to another aspect of the present invention comprises:

a preparation step of preparing a coated soft magnetic powder including a plurality of coated soft magnetic particles prepared by coating the outer circumferential surface of soft magnetic particles composed of an iron-based material with an insulating layer including a coating layer composed mainly of a phosphate;

a powder heat treatment step of subjecting the coated soft magnetic powder to heat treatment to produce a heat-treated coated powder in which the insulating layer has been partially crystallized;

a molding step of subjecting the heat-treated coated powder to compression molding to produce a compact; and a compact heat treatment step of subjecting the compact to heat treatment to remove strain introduced into the soft magnetic particles in the molding step.

With the above manufacturing method, a dust core with high density and low loss can be manufactured.

By preparing the coated soft magnetic particles including the coating layer formed of the above-described material and then subjecting the coated soft magnetic particles to heat treatment in the powder heat treatment step, the strain in the soft magnetic particles is removed, and the soft magnetic particles can thereby be softened. Therefore, the soft magnetic particles can be easily deformed in the molding step, and a high-density compact can be easily produced.

As a result of the heat treatment in the powder heat treatment step, the insulating layer is partially crystallized and is thereby embrittled, and the soft magnetic particles are softened. In this case, parts of the surface layer portion of the insulating layer are easily peeled off during the compression in the molding step, and insulating pieces separated from the insulating layer are thereby formed. The technical meaning of the partial crystallization of the insulating layer is that, in order to manufacture a dust core with high density and low loss, insulating pieces separated from the insulating layer are formed while the surface of the soft magnetic particles is substantially prevented from being exposed from the insulating layer. As described above, the soft magnetic particles are not exposed from the insulating layer, and the insulating pieces function as a lubricant. In this case, the pressure acting on the non-peeled insulating layer is reduced during molding, and the insulation between the particles can be maintained, so that a compact with low loss can be easily produced. In the molding step, the insulating pieces move to regions surrounded by at least three mutually adjacent soft magnetic particles and stay in these region after the compact heat treatment step.

(11) In one mode of the dust core manufacturing method, the heat treatment in the powder heat treatment step is performed at a temperature of higher than 350° C. and lower than 700° C.

When the heat treatment temperature is higher than 350° C., the strain in the soft magnetic particles can be removed, and the insulating layer can be partially crystallized. Therefore, a high-density compact can be easily produced in the molding step described later, and the density of the dust core can be easily increased. When the heat treatment temperature is lower than 700° C., the insulating layer is prevented from being completely crystallized. In this case, the insulating layer is prevented from peeling off to the extent that the surface of the soft magnetic particles is exposed from the insulating layer in the molding step described later. Therefore, a low-loss dust core can be easily manufactured.

(12) In another mode of the dust core manufacturing method, the insulating layer in the heat-treated coated powder is composed mainly of iron phosphate containing iron in an amount of from 20 atom % to 37 atom % inclusive.

In the above manufacturing method, parts of the surface layer portion of the insulating layer can be peeled off in the subsequent molding step while the surface of the soft magnetic particles is prevented from being exposed from the insulating layer, and the insulating pieces separated from the insulating layer can thereby be easily formed.

(13) In another mode of the dust core manufacturing method, the heat-treated coated powder has a Vickers hardness of 120 HV or less.

In the above manufacturing method, since the heat-treated coated powder is soft, a high-density compact can be easily produced in the molding step. Therefore, a high-density dust core can be easily manufactured.

(14) In another mode of the dust core manufacturing method, the molding step is performed while the heat-treated coated powder is heated to from 80° C. to 150° C. inclusive.

When the molding temperature is 80° C. or higher, the heat-treated coated powder can be easily deformable, and a high-density compact can be easily produced. When the molding temperature is 150° C. or lower, excessive deformation of the heat-treated coated powder can be easily prevented. Therefore, damage to the insulating layer caused by the deformation can be prevented, and an increase in eddy-current loss can be easily prevented.

(15) in another mode of the dust core manufacturing method, the compact heat treatment step is performed in an atmosphere with an oxygen concentration of more than 0 ppm by volume and 10,000 ppm by volume or less at a heat treatment temperature of from 350° C. to 900° C. inclusive for a heat treatment time of from 10 minutes to 60 minutes inclusive.

In the above manufacturing method, since the strain in the soft magnetic particles included in the dust core can be sufficiently removed, hysteresis loss can be reduced, and a low-loss dust core can be easily manufactured.

<<Details of Embodiments of the Present Invention>>

The details of embodiments of the present invention will be described. First, a dust core according to an embodiment will be described, and then a method for manufacturing the dust core and an electromagnetic component including the dust core will be described. However, the present invention is not limited to these examples. The present invention is defined by the scope of the claims and is intended to include any modifications within the scope of the claims and meaning equivalent to the scope of the claims.

[Dust Core]

Referring to FIG. 1, a dust core 1 according to an embodiment will be described. The dust core 1 comprises a plurality of soft magnetic particles 2 and an insulating layer 3 interposed between adjacent soft magnetic particles 2. One feature of the dust core 1 is that the insulating layer 3 includes a coating layer 31 that is composed mainly of a specific material and covers the surface of the soft magnetic particles 2. Another feature is that the dust core 1 further comprises specific insulating pieces 4 each disposed so as to be surrounded by at least three mutually adjacent soft magnetic particles 2. Although the details will be described later in a manufacturing method section, in the dust core 1 in which the insulating pieces 4 are disposed so as to be surrounded by at least three mutually adjacent soft magnetic particles 2, high density and low core loss are achieved. The shape of the dust core 1 shown in FIG. 1 is an example, and the internal structure of the dust core 1 is exaggerated for the sake of description.

[Soft Magnetic Particles]

(Composition)

The material of the soft magnetic particles 2 is an iron-based material, and examples of the iron-based material include pure iron (purity: 99% by mass or more, the balance: unavoidable impurities) and iron alloys such as Fe—Si—Al-based alloys, Fe—Si-based alloys, and Fe—Al-based alloys. Particularly preferably, in terms of magnetic permeability and magnetic flux density, the martial of the soft magnetic particles is pure iron.

(Particle Diameter)

The average particle diameter of the soft magnetic particles 2 is preferably from 50 μm to 400 μm inclusive. When the average particle diameter is 50 μm or more, the dust core is more likely to have high-density. When the average particle diameter is 400 μm or less, the eddy-current loss in the soft magnetic particles 2 themselves can be easily reduced, so that the dust core 1 is more likely to have low loss. The average particle diameter of the soft magnetic particles 2 is more preferably from 50 μm to 150 μm inclusive and particularly preferably from 50 μm to 70 μm inclusive. The average particle diameter of the soft magnetic particles 2 can be measured by capturing an image of a cross section under an SEM (scanning electron microscope) and analyzing the image using commercial image analysis software. In this case, the equivalent circle diameter of a particle is used as the diameter of the particle. The circle-equivalent diameter of a soft magnetic particle 2 is obtained as follows. The outline of the soft magnetic particle is determined, and the diameter of a circle having the same area as the area S surrounded by the outline is used as the circle-equivalent diameter. Specifically, the circle-equivalent diameter is represented by $2\times\{\text{area S surrounded by outline}/\pi\}^{1/2}$. The average particle diameter of the soft magnetic particles 2 included in the dust core 1 is substantially the same as the average particle diameter of soft magnetic particles included in a raw material powder of the dust core 1.

[Insulating Layer]

The insulating layer 3 included in the dust core 1 improves the insulation between the soft magnetic particles 2. The structure of the insulating layer 3 has been substantially completely crystallized. The structure of the insulating layer 3 can be analyzed by X-ray diffraction (measurement of peak strengths) or TEM (transmission electron microscope) observation.

(Coating Layer)

The insulating layer 3 includes the coating layer 31 formed so as to cover the surface (outer circumferential surface) of the soft magnetic particles 2. The coating layer 31 is interposed between the soft magnetic particles 2 to improve the insulation between the soft magnetic particles 2.

<Material>

The material of the coating layer 31 may be a phosphate compound composed mainly of a phosphate. Specific examples of the phosphate include iron phosphate. Preferably, the coating layer 31 has a composition including phosphorus in an amount of from 10 atom % to 1.5 atom % inclusive and iron in an amount of from 22 atom % to 40 atom % inclusive with the balance being oxygen and unavoidable impurities. In this case, the dust core is more likely to have high density and low loss. This is because of the following reason. Parts of the surface of the coating layer 31 are peeled off during compression molding described later and form the insulating pieces 4 separated from the insulating layer 3, and the insulating pieces 4 function as a lubricant. The coating layer 31 is substantially prevented from peeling off to the extent that the soft magnetic particles 2 are exposed, and therefore the insulation between the soft magnetic particles 2 can be easily maintained. The content of iron in the coating layer 31 may be 37 atom % or less and particularly 35 atom % or less. The content of iron in the coating layer 31 may be 24 atom % or more. The composition of the coating layer 31 can be analyzed by EDX (energy dispersive X-ray) analysis using a TEM. In this case, the analysis is performed at 10 or more points in a cross section of the dust core 1, and the average is used as the composition of the coating layer 31.

<Thickness>

Preferably, the thickness of the coating layer 31 is from 30 nm to 120 nm inclusive. When the thickness of the coating layer 31 is 30 nm or more, the insulation between the soft magnetic particles 2 can be easily improved. When the thickness of the coating layer 31 is 120 nm or less, the dust core 1 is more likely to have high density. The thickness of the coating layer 31 is more preferably from 35 nm to 100 am inclusive and particularly preferably from 40 nm to 70 nm inclusive. The thickness of the coating layer 31 can be measured by observing a cross section of the dust core 1 under a TEM and subjecting the observed image to image analysis. In this case, the number of observation fields is 20 or more, and the magnification is from 50,000× to 300,000× inclusive. The average thicknesses in the observation fields are determined and averaged, and the average for all the observation fields is used as the thickness of the coating layer 31. The thicknesses of broken (peeled) portions of the coating layer 31 are eliminated from the measurement range. The thickness of the coating layer 31 included in the dust core 1 is substantially the same as the thickness of the coating layer of the coated soft magnetic particles included in the raw material powder of the dust core 1.

(Outer Layer)

Preferably, the insulating layer 3 included in the dust core 1 includes an outer layer 32 formed outward of the coating layer 31. The outer layer 32 is interposed between coating layers 31.

<Material>

Preferably, the material of the outer layer 32 is composed mainly of O and one element selected from Si, Mg, Ti, and Al. Specifically, the material is preferably composed mainly of one compound selected from a silicate compound composed mainly of Si and O, a magnesium oxide composed mainly of Mg and O, a titanium oxide composed mainly of Ti and O, and an aluminum oxide composed mainly of Al and O. In this case, high density and low loss can be easily achieved simultaneously. Like the coating layer 31 described above, the outer layer 32 is peeled off during the compression molding described later and forms insulating pieces 4 separated from the insulating layer 3, and the insulating pieces 4 function as a lubricant. The amount of the coating layer 31 peeled off during the compression molding is less than that when only the coating layer 31 is provided, and the coating layer 31 is substantially prevented from peeling off to the extent that the soft magnetic particles 2 are exposed, so that the insulation between the soft magnetic particles 2 can be easily maintained. Examples of the silicate compound include potassium silicate ($K_2SiO_3$), sodium silicate ($Na_2SiO_3$: referred to also as water glass or silicate soda), lithium silicate ($Li_2SiO_3$), and magnesium silicate ($MgSiO_3$). Examples of the magnesium oxide include MgO. Examples of the titanium oxide include $TiO_2$. Examples of the aluminum oxide include $Al_2O_3$. The material of the outer layer 32 can be analyzed by the same method as the above-described method for analyzing the composition of the coating layer 31.

<Thickness>

Preferably, the thickness of the outer layer 32 is from 10 nm to 100 nm inclusive. When the thickness of the outer layer 32 is 10 nm or more, the insulation between the soft magnetic particles 2 can be easily improved. When the thickness of the outer layer 32 is 100 nm or less, the dust core 1 is more likely to have high density. The thickness of the outer layer 32 is more preferably from 20 nm to 90 nm inclusive and particularly preferably from 30 nm to 80 nm inclusive. The thickness of the outer layer 32 can be measured by the same method as the above-described method for measuring the thickness of the coating layer 31. The thickness of the outer layer 3 included in the dust core 1 is substantially the same as the thickness of the outer layer of the coated soft magnetic particles included in the raw material powder of the dust core 1.

The thickness of the insulating layer 3 (the total thickness of the coating layer 31 and the outer layer 32 when the outer layer 32 is provided) may be from 40 nm to 220 nm inclusive, provided that the thickness of the coating layer 31 and the thickness of the outer layer 32 fall within their respective thickness ranges.

[Insulating Pieces]

The insulating pieces 4 included in the dust core 1 are disposed so as to be surrounded by at least three mutually adjacent soft magnetic particles 2. Each of the insulating pieces 4 is often disposed in a region around a triple point surrounded by three mutually adjacent soft magnetic particles 2, a region surrounded by four mutually adjacent soft magnetic particles 2, etc. in many cases, the number of insulating pieces 4 in each region is 2 or more. However, only one insulating piece 4 may be present in a certain region, and no insulating piece 4 may be present at all in a certain region.

(Presence Form)

The insulating pieces 4 are present in such a form that they are separated from the insulating layer 3. The insulating pieces 4 present in the separated form include insulating pieces 4 that are not in contact with the insulating layer 3 with a gap therebetween and insulating pieces 4 that are in contact with the insulating layer 3. However, the insulating pieces 4 that are in contact with the insulating layer 3 are discontinuous with the insulating layer 3 (are not formed so as to be continuous with the insulating layer 3) and are independent of the insulating layer 3. Although the details will be described later in the manufacturing method section, the insulating pieces 4 are portions peeled off the insulating layer 3 during the production process and are originally parts of the insulating layer 3.

(Material)

The material of the insulating pieces 4 is substantially the same as the material forming the insulating layer 3. This is because the insulating pieces 4 are parts of the insulating layer 3 that have been peeled off during the production process. Specifically, when the insulating layer 3 includes only the coating layer 31, the material of the insulating pieces 4 is composed substantially of the phosphate. When the insulating layer 3 includes the coating layer 31 and the outer layer 32, the material of each of the insulating pieces 4 is composed (1) substantially only of the phosphate, (2) of both the phosphate and an oxide such as a silicate compound, or (3) substantially only of an oxide such as a silicate compound. When the material of an insulating piece 4 includes both the phosphate and an oxide such as a silicate compound, this insulating piece 4 is a joined piece composed of the phosphate and the oxide such as the silicate compound. The material of the insulating pieces 4 can be analyzed by the same method as the above-described method for analyzing the composition of the coating layer 31.

The content of iron in the insulating pieces 4 is less than the content of iron in the insulating layer 3. The details of this will be described later in the manufacturing method section. Specifically, it is preferable that the content of iron in the insulating pieces 4 satisfies [(the content of iron in the insulating layer 3)−(the content of iron in the insulating pieces 4≤4.5 atom %]. In this case, the dust core is more likely to have high density and low loss.

Preferably, the insulating pieces 4 have a composition including phosphorus in an amount of from 10 atom % to 15 atom % inclusive and iron in an amount of from 20 atom % to 37 atom % inclusive, with the balance being oxygen and unavoidable impurities. In this case, the dust core is more likely to have high density and low loss. The content of iron in the insulating pieces 4 may be from 22 atom % to 35 atom % inclusive and may be particularly from 24 atom % to 30 atom % inclusive. The composition of the insulating pieces 4 can be analyzed by the same method as the above-described method for analyzing the composition of the coating layer 31.

(Size)

Preferably, the size of the insulating pieces 4 is, for example, from 0.3 μm to 5.0 μm inclusive. The size of an insulating piece 4 is the longitudinal length of a strip-shaped piece observed in an image of a cross section of the dust core 1 under an SEM. Specifically, at least 100 regions which are surrounded by at least three mutually adjacent soft magnetic particles 2 and in which an insulating piece 4 is present are observed, and the average of the lengths of the strip-shaped insulating pieces 4 present in the above regions is used as the size of the insulating pieces 4. When the size of the insulating pieces 4 is 0.3 μm or more, the dust core 1 is more likely to have high density. This is because the insulating pieces 4 function as a lubricant for the soft magnetic particles 2 during the compression molding and this allows the pressure acting on the non-peeled insulating layer 3 to be easily reduced. When the size of the insulating pieces 4 is 5.0 μm or less, the dust core 1 is more likely to have low loss. This is because of the following reason. The degree of peeling of the insulating layer 3 during the compression molding is small, and the coating layer 31 is substantially prevented from peeling off to the extent that the soft magnetic particles 2 are exposed, so that the insulation between the soft magnetic particles 2 can be easily maintained. The size of the insulating pieces 4 is more preferably from 0.4 μm to 4.5 μm inclusive and particularly preferably from 0.5 μm to 4.0 μm inclusive.

(Presence Ratio)

Preferably, the presence ratio of the insulating pieces 4 is, for example, from 5% to 90% inclusive. The presence ratio is determined as follows. At least 100 regions surrounded by at least three mutually adjacent soft magnetic particle 2 are observed, and the ratio of the number of regions in which an insulating piece is present is determined and used as the presence ratio. When even one insulating piece is present in a region, this region is counted as a region including an insulating piece. When the presence ratio is 5% or more, the insulating pieces 4 can easily function as a lubricant during the compression molding, and the dust core 1 is more likely to have high density. When the presence ratio is 90% or less, the coating layer 31 is substantially prevented from peeling off to the extent that the soft magnetic particles 2 are exposed during the compression molding, and the dust core 1 is more likely to have low loss. The presence ratio of the insulating pieces 4 is more preferably from 7% to 87% inclusive and particularly preferably from 10% to 85% inclusive.

(Structure)

The structure of the insulating pieces 4 has been substantially completely crystallized, as does the structure of the insulating layer 3. The structure of the insulating pieces 4 can be analyzed by the same method as the method for analyzing the structure of the insulating layer 3.

[Density]

The density of the dust core 1 is, for example, 7.5 g/cm$^3$ or more. The density is preferably 7.55 g/cm$^3$ or more and more preferably 7.6 g/cm$^3$ or more. The density is determined as follows. The volume of the dust core 1 is measured using the Archimedes method, and the mass of the dust core 1 is divided by the measured volume (mass/volume).

[Properties]

(Electrical Resistivity)

The electrical resistivity of an inner portion of the dust core 1 may be $5\times10^{-1}$ Ω·cm or more. When the electrical resistivity is $5\times10^{-1}$ Ω·cm or more, the eddy-current loss can be reduced, and an electromagnetic component excellent in magnetic properties can be easily constructed. The electrical resistivity is preferably $1\times10^{0}$ Ω·cm or more and particularly preferably $1\times10^{1}$ Ω·cm or more. The higher the electrical resistivity, the more the eddy-current loss can be reduced, which is preferred. Therefore, no particular limitation is imposed on the upper limit of the electrical resistivity. However, the upper limit of the electrical resistivity may be, for example, about $1\times10^{7}$ ∩·cm or less. The electrical resistivity can be measured on a cross section of the dust core 1 using a four-probe method.

(Magnetic Properties)

The dust core 1 has low loss. For example, its core loss W1/10 k is 200 kW/m$^3$ or less. The core loss W1/10 k is a value measured at an excitation magnetic flux density Bm of 0.1 T, a measurement frequency of 10 kHz, and room temperature (20° C.±15° C.). The core loss W1/10 k is preferably 150 kW/m$^3$ or less, more preferably 125 kW/m$^3$ or less, and particularly preferably 120 kW/m$^3$ or less. The eddy-current loss is 30.0 kW/m$^3$ or less and is less than 30.0 kW/m$^3$. The eddy-current loss is preferably 27.5 kW/m$^3$ or less and particularly preferably 25.0 kW/m$^3$ or less.

[Applications]

The dust core 1 can be preferably used for magnetic cores of various electromagnetic components (such as electric reactors, transformers, motors, choke coils, antennas, fuel injectors, and ignition coils) and the materials of these electromagnetic components.

[Operational Advantage of Dust Core]

The above dust core 1 has high density and low loss.

[Method for Manufacturing Dust Core]

The dust core can be manufactured by a dust core manufacturing method including: a preparation step of preparing a coated soft magnetic powder; a powder heat treatment step of producing a heat-treated coated powder; a molding step of producing a compact; and a compact heat treatment step. A mixing step of mixing the heat-treated coated powder with a lubricant may be provided after the powder heat treatment step but before the molding step. A main feature of the dust core manufacturing method is that the method includes the powder heat treatment step. The details of these steps will be described successively.

[Preparation Step]

In the preparation step, the coated soft magnetic powder is prepared. The coated soft magnetic powder includes a plurality of coated soft magnetic particles including: the soft magnetic particles composed of the above-described material and having the above-described particle diameter; and the insulating layer formed on the outer circumferential surface of the soft magnetic particles, composed of the above-described material, and having the above-described thickness. To prepare the coated soft magnetic powder, for example, the soft magnetic particles are prepared, and then the insulating layer is formed on the outer circumferential surface of the soft magnetic particles.

To prepare the soft magnetic particles, the soft magnetic particles may be manufactured by an atomization method such as a gas atomization method or a water atomization method, or commercial soft magnetic particles may be purchased.

To form the insulating layer on the outer circumferential surface of the soft magnetic particles, chemical conversion treatment, for example, may be used. The chemical conversion treatment may be used for both the coating layer and the outer layer. In this case, the insulating layer formed on the outer circumferential surface of the soft magnetic particles is substantially entirely amorphous. Specifically, when the insulating layer includes the outer layer, both the coating layer and the outer layer are substantially entirely amorphous. The structure of the insulating layer (both the coating layer and the outer layer when the outer layer is provided) is partially crystallized through the powder heat treatment step described later, and the rest of the structure is (completely) crystallized through the compact heat treatment step.

When a coating layer composed mainly of iron phosphate is formed on the outer circumferential surface of the soft magnetic particles, it is preferable that the coating layer has a composition including, for example, phosphorus in an amount of from 10 atom % to 15 atom % inclusive and iron in an amount of from 15 atom % to 20 atom % inclusive with the balance being oxygen and unavoidable impurities. As the coating layer is sequentially subjected to the powder heat treatment step and the compact heat treatment step, the content of iron contained in the coating layer increases, and the content of oxygen contained in the coating layer decreases. This is because, during the heat treatment, the iron component in the soft magnetic particles diffuses into the insulating layer (coating layer) and oxygen contained in the insulating layer leaves the insulating layer. Therefore, when the content of iron in the coating layer is within the above range, the above-described dust core including the coating layer containing a prescribed amount of iron can be manufactured through the powder heat treatment step and the compact heat treatment step. The content of iron in the coating layer may be from 16 atom % to 19 atom % inclusive and particularly from 17 atom % to 19 atom % inclusive.

[Powder Heat Treatment Step]

In the powder heat treatment step, the coated soft magnetic powder is subjected to heat treatment to produce a heat-treated coated powder in which the insulating layer has been partially crystallized. When the insulating layer includes the outer layer, each of the coating layer and the outer layer is partially crystallized. The heat treatment causes parts of the insulating layer (mainly crystallized parts (parts of the surface layer portion)) to be embrittled. These parts of the surface layer portion of the insulating layer are easily peeled off in the molding step described later and form insulating pieces separated from the insulating layer.

When the coating layer in the insulating layer of the heat-treated coated powder is composed mainly of iron phosphate, it is preferable that the composition of the coating layer includes, for example, phosphorus in an amount of from 10 atom % to 15 atom % inclusive and iron in an amount of from 20 atom % to 37 atom % inclusive, with the balance being oxygen and unavoidable impurities. The content of iron contained in the coating layer increases during the compact heat treatment step described later. Therefore, when the content of iron in the coating layer is within the above range, the above-described dust core can be easily manufactured through the compact heat treatment step. Since the insulating pieces peeled off the coating layer in the molding step are less susceptible to the influence of diffusion of the iron component from the soft magnetic particles during the heat treatment in the compact heat treatment step, the content of iron in the insulating pieces is likely to be substantially maintained at the content of iron in the coating layer of the heat-treated coated powder. Therefore, the content of iron in the insulating pieces is likely to be less than the content of iron in the coating layer that has been increased through the compact heat treatment step. The content of iron in the coating layer may be from 22 atom % to 35 atom % inclusive and particularly from 24 atom % to 30 atom % inclusive.

Preferably, the Vickers hardness of the heat-treated coated powder is 120 HV or less. When the Vickers hardness of the heat-treated coated powder is 120 HV or less, the heat-treated coated powder is soft. In this case, a high-density compact can be easily produced in the molding step described later, and therefore a high-density dust core can be easily manufactured. The Vickers hardness is more preferably 115 HV or less. If the Vickers hardness is excessively low, the soft magnetic particles may deform excessively in the molding step, and the deformation may exceed the deformability of the insulating layer, causing the insulating layer to be damaged. The Vickers hardness is preferably more than 80 HV and more preferably 85 HV or more. The Vickers hardness is a value obtained by embedding the heat-treated coated powder in a resin, polishing the resin such that soft magnetic particles included in the heat-treated coated powder are exposed, and then performing the measurement on the exposed soft magnetic particles (the average of n=10).

(Temperature)

Preferably the heat treatment temperature is higher than 350° C. and lower than 700° C. When the heat treatment temperature is higher than 350° C., strain in the soft magnetic particles can be removed, and the insulating layer can be partially crystallized. Therefore, a high-density compact can be easily produced in the molding step described later. When the heat treatment temperature is lower than 700° C., the insulating layer can be crystallized only partially and prevented from being completely crystallized. Therefore, a reduction in the electrical resistivity of the insulating layer can be prevented, and the insulating layer can be prevented from peeling off to the extent that the surface of the soft magnetic particles is exposed from the insulating layer in the molding step described later. A dust core with low loss can thereby by easily manufactured. The heat treatment temperature is more preferably from 400° C. to 650° C. inclusive and particularly preferably from 450° C. to 600° C. inclusive.

(Time)

The heat treatment time depends on the heat treatment temperature but is preferably, for example, 15 minutes or longer. In this case, the insulating layer can be partially crystallized easily. The upper limit of the heat treatment time is set to, for example, 120 minutes or shorter such that the insulating layer is not completely crystallized.

(Atmosphere)

The heat treatment atmosphere may be an inert gas atmosphere such as nitrogen or a reduced pressure atmosphere (e.g., a vacuum atmosphere with a pressure lower than standard atmospheric pressure).

[Mixing Step]

The mixing step of mixing the coated soft magnetic powder with a lubricant to prepare a material mixture may be provided. Examples of the lubricant include metallic soaps, fatty acid amides, higher fatty acid amides, inorganic materials, and fatty acid metal salts. Examples of the metallic soaps include zinc stearate and lithium stearate. Examples of the fatty acid amides include stearic acid amide. Examples of the higher fatty acid amides include ethylene bis-stearic acid amide. Examples of the inorganic materials include boron nitride and graphite. A fatty acid metal salt is composed of a fatty acid and a metal. Examples of the fatty acid include caprylic acid, pelargonic acid, capric acid, undecanoic acid, lauric acid, tridecanoic acid, myristic acid, pentadecanoic acid, palmitic acid, margaric acid, stearic acid, nonadecanoic acid, arachic acid, heneicosanoic acid, behenic acid, tricosanoic acid, lignoceric acid, pentacosanoic acid, serotic acid, heptacosanoic acid, and montanic acid. Examples of the metal include Mg, Ca, Zn, Al, Ba, Li, Sr, Cd, Ph, Na, and K. By adding the lubricant, lubricity during molding can be further improved. The amount of the lubricant added is preferably from 0.005% by mass to 0.6% by mass inclusive when the total mass of the heat-treated coated powder and the lubricant is taken as 100% by mass. When the amount of the lubricant falls within the above range, the effect of improving lubricity by the addition of the lubricant can be easily obtained sufficiently, and a reduction in the ratio of the metal component in the compact can be prevented. The lubricant may be in the form of powder or liquid. The lubricant burns off substantially in the compact heat treatment step.

[Molding Step]

In the molding step, the material mixture (the heat-treated coated powder) is subjected to compression molding to produce a compact. To produce the compact, the material mixture is charged into a molding die capable of forming a prescribed shape, and the material mixture in the die is pressurized. The shape of the compact may be selected according to the shape of a magnetic core of an electromagnetic component.

In the molding step, the surface of the insulating layer is partially peeled off to the extent that the surface of the soft magnetic particles in the heat-treated coated powder is not exposed from the insulating layer, and insulating pieces separated from the insulating layer are thereby formed. Specifically, mainly crystallized parts (parts of the surface layer portion) of the insulating layer are peeled off, and the insulating pieces are thereby formed. When the insulating layer includes only the coating layer, the insulating pieces are composed of the constituent material of the coating layer. When the insulating layer includes the coating layer and the outer layer, the insulating pieces are composed of at least one of the constituent material of the coating layer, a combination of the constituent material of the coating layer and the constituent material of the outer layer, and the constituent material of the outer layer. The insulating pieces are compressed by the particles of the heat-treated coated powder and move to regions surrounded by at least three mutually adjacent soft magnetic particles. During this process, the insulating pieces function as a lubricant for the particles of the heat-treated coated powder.

(Pressure)

Preferably, the molding pressure is 500 MPa or more. When the molding pressure is 500 MPa or more, a high-density compact can be easily produced. The molding pressure is more preferably 800 MPa or more and particularly preferably 950 MPa or more. Preferably, the upper limit of the molding pressure is, for example, 2,500 MPa or less. In this case, damage to the insulating layer can be prevented, and the life of the molding die is not significantly impaired. The molding pressure is more preferably 2,000 MPa or less and particularly preferably 1,700 MPa or less.

(Temperature)

The molding temperature may be equal to or higher than room temperature (normal temperature). The molding temperature is the temperature of the molding die. The insulating pieces peeled off the insulating layer are formed during the compression molding, and lubricity is thereby improved. Therefore, even when the molding temperature is room temperature, a high-density compact can be easily produced. The molding temperature is more preferably 80° C. or higher. When the molding temperature is 80° C. or higher, a higher density compact can be easily produced. Preferably, the upper limit of the molding temperature is 150° C. or lower. When the molding temperature is 150° C. or lower, an increase in eddy-current loss can be easily prevented. Particularly preferably, the molding temperature is from 100° C. to 130° C. inclusive.

A lubricant may be applied to portions of the molding die that are to be in contact with the composite material. In this case, friction with the powder is reduced, and a high-density compact can be easily produced. The material of the lubricant may be the same as the material of the above-described lubricant.

[Compact Heat Treatment Step]

In the compact heat treatment step, the compact is subjected to heat treatment to remove the strain introduced into the soft magnetic particles in the molding step. As a result of the heat treatment, the insulating layer and the insulating pieces are substantially completely crystallized. When the insulating layer includes the outer layer, the rest of the coating layer and the rest of the outer layer are (completely) crystallized. The insulating pieces stay in their respective regions surrounded by at least three mutually adjacent soft magnetic particles and may or may not be in contact with the insulating layer.

In the atmosphere during the heat treatment, the concentration of oxygen may be more than 0 ppm by volume and 10,000 ppm by volume or less and may be from 100 ppm by volume to 5,000 ppm by volume inclusive and particularly from 200 ppm by volume to 1,000 ppm by volume inclusive. Preferably, the heat treatment temperature is from 350° C. to 900° C. inclusive. The heat treatment temperature is more preferably 600° C. or higher, still more preferably 625° C. or higher, and particularly preferably 650° C. or higher. The heat treatment temperature is more preferably 750° C. or lower and particularly preferably 700° C. or lower. The heat treatment time is preferably from 10 minutes to 60 minutes inclusive, more preferably from 10 minutes to 30 minutes inclusive, and particularly preferably from 10 minutes to 15 minutes inclusive. When the compact is heat-treated under the above conditions, the strain in the soft magnetic particles can be sufficiently removed, and the hysteresis loss can be reduced, so that a low-loss dust core can be easily manufactured.

[Applications]

The dust core manufacturing method can be preferably used to produce the dust core 1 described above.

[Operational Advantages of Dust Core Manufacturing Method]

With the dust core manufacturing method described above, since the powder heat treatment step is provided, a high-density low-loss dust core can be manufactured because of the following (1) to (5).

(1) The strain in the soft magnetic particles can be removed, and the soft magnetic particles are thereby softened. Therefore, the soft magnetic particles can be easily deformed in the molding step, and a high-density compact can be easily produced.

(2) Since the coating layer formed of iron phosphate is partially crystallized and embrittled, the surface layer portion of the insulating layer is partially peeled off when the soft magnetic particles are deformed in the molding step, and insulating pieces separated from the insulating layer can thereby be formed. Since the insulating pieces function as a lubricant in the molding step, the pressure acting on the non-peeled insulating layer can be lower than that when conventional non-heat-treated particles are used as the coated soft magnetic particles. Therefore, the soft magnetic particles are substantially prevented from being exposed from the insulating layer, and breakage of the non-peeled insulating layer can be prevented, so that the insulation between the particles can be improved. Since the insulation between the soft magnetic particles is improved, a low-loss compact can be easily produced.

(3) When the insulating layer includes the coating layer formed of iron phosphate and the outer layer formed of a silicate compound, insulating pieces composed of the iron phosphate and also insulating pieces composed of the silicate compound can be formed. In this case, improved lubricating function is obtained, and the pressure acting on the non-peeled insulating layer can be further reduced.

(4) Portions in the vicinity of the surface layer of the soft magnetic particles in the coated soft magnetic particles are oxidized, and the eddy-current loss can thereby be reduced. Therefore, a low-loss dust core can be easily produced.

(5) The softening of the soft magnetic particles in the powder heat treatment step described above and the formation of the insulating pieces allow high density to be achieved even when the molding temperature is set to room temperature at which low loss is generally easy to achieve but high density is difficult to achieve, in addition, even when the molding temperature is set to high temperature at which high density is generally easy to achieve but low eddy-current loss is difficult to achieve, the eddy-current loss can be reduced. Therefore, a high-density low-loss dust core can be easily manufactured, irrespective of whether the molding temperature is room temperature or high temperature.

[Electromagnetic Component]

An electromagnetic component includes a coil formed by winding a wire and a magnetic core around which the coil is disposed. At least part of the magnetic core is the above-described dust core or a dust core obtained by the above-described manufacturing method.

The wire may include a conductor and an insulating layer disposed on the outer circumferential surface of the conductor, the conductor may be a wire material formed of a conductive material such as copper, a copper alloy, aluminum, or an aluminum alloy. Examples of the constituent material of the insulating layer include enamel, tetrafluoroethylene-hexafluoropropylene copolymer (FEP) resin, polytetrafluoroethylene (PTFE) resin, and silicone rubber. Any know wire can be used.

The shape of the magnetic core is typically a columnar shape or an annular shape. A plurality of dust cores may be combined to form columnar magnetic cores and annular magnetic cores having different sizes. The entire part of the magnetic core may be formed from the above-described dust core, or only a part of the magnetic core may be formed from the above-described dust core. In the latter case, the dust core may be combined with a magnetic core component formed from different materials such as a magnetic laminated steel sheet or a composite material (cured molded body) prepared by dispersing a soft magnetic powder in a resin. The magnetic core may include an air gap or a gap member having a lower magnetic permeability than the dust core and the magnetic core component, particularly a gap member formed from a non-magnetic material.

Figure 2:
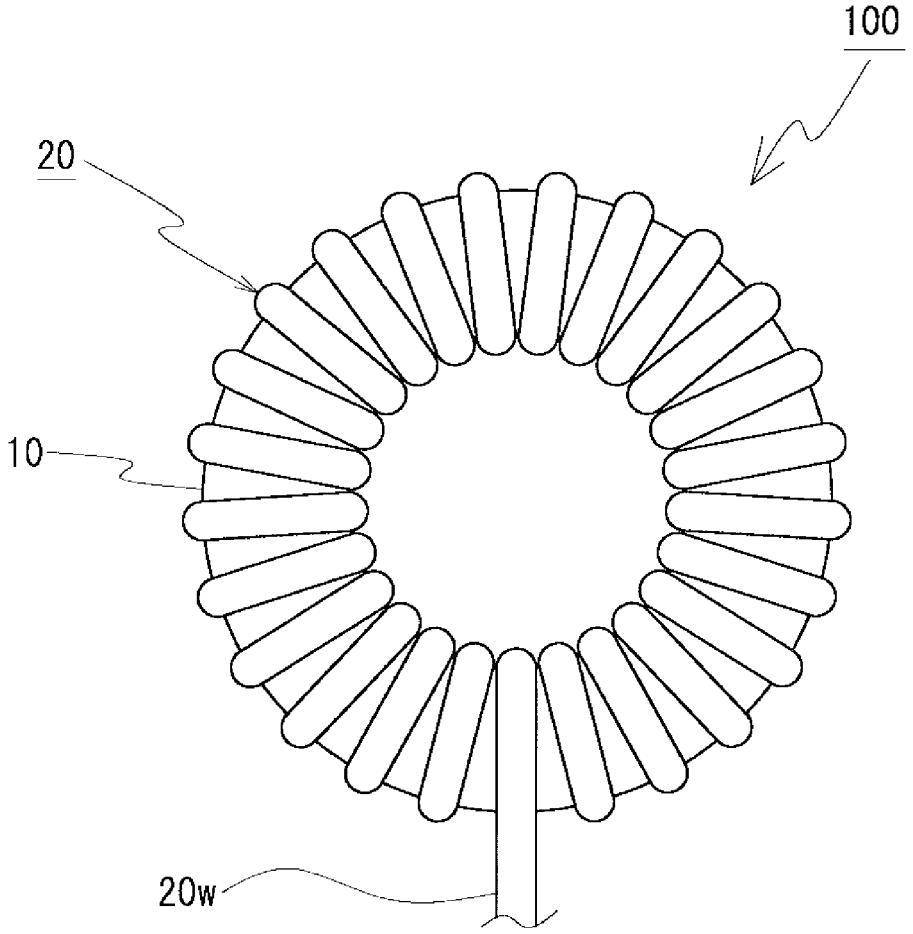
FIG. 2 is a plan view of a choke coil using the dust core according to the embodiment.

An example of the electromagnetic component is shown in FIG. 2. A coil component 100 in FIG. 2 is a choke coil including an annular magnetic core 10 and a coil 20 formed by winding a wire 20*w* around the outer circumferential surface of the magnetic core 10. The annular magnetic core 10 is formed from the above-described dust core. Other examples of the electromagnetic component include high-frequency choke coils, high-frequency tuning coils, bar antenna coils, choke coils for power supplies, power transformers, transformers for switching power supplies, and electric reactors.

[Applications]

The electromagnetic component can be preferably used for electric reactors, transformers, motors, choke coils, antennas, fuel injectors, ignition coils, etc.

Test Example 1

Dust core samples were produced, and the density, electrical resistivity, and magnetic properties of each sample were evaluated.

[Samples Nos. 1-1 to 1-5]

Dust core samples Nos. 1-1 to 1-5 were produced in the same manner as the above-described dust core manufacturing method including, in the following order, the preparation step, the powder heat treatment step, the mixing step, the molding step, and the compact heat treatment step.

[Preparation Step]

The outer circumferential surface of soft magnetic particles was coated with an insulating layer to produce a coated soft magnetic powder. The soft magnetic powder prepared was a pure iron powder having a purity of 99% by mass or more, with the balance being unavoidable impurities. The average particle diameter of the soft magnetic particles was 53 μm. The average particle diameter is a particle diameter value at a cumulative percentage of 50% accumulated from a small-diameter side in a mass-based particle size distribution measured using a commercial laser diffraction-scattering-type particle diameter-particle size distribution analyzer.

Next, the soft magnetic powder was subjected to bonderizing to form a coating layer formed of iron phosphate on the outer circumferential surface of the particles of the powder. Then the resulting soft magnetic powder was subjected to chemical conversion treatment to form an outer layer composed mainly of Si—O (a silicate compound) on the outer circumferential surface of the coating layer. The thickness of the coating layer was 102 nm, and the thickness of the outer layer was 31 nm. The thickness of the coating layer and the thickness of the outer layer can be measured by observing a cross section of a dust core under a TEM and subjecting the observation image to image analysis. In the measurement, the number of observation fields was 20, and the magnification was from 50,000× to 300,000× inclusive. The average thickness of the coating layer and the average thickness of the outer layer were determined in each of the observation fields. Then the average thicknesses of the coating layer and the average thicknesses of the outer layer in all the observation fields were averaged, and the averages were used as the thicknesses of the coating layer and the outer layer. The thicknesses of broken (peeled) portions of the coating layer and the outer layer were eliminated from the measurement range.

[Powder Heat Treatment Step]

The coated soft magnetic powder was subjected to heat treatment to prepare heat-treated coated powders. The heat treatment was performed in a nitrogen atmosphere at temperatures shown in Table 1 for a time of 15 minutes.

(Vickers Hardness Measurement)

For each of samples Nos. 1-1, 1-2, and 1-5 among samples Nos. 1-1 to 1-5, the Vickers hardness of the soft magnetic particles in the heat-treated coated powder was measured after the powder heat treatment step. The results are shown in Table 2. The Vickers hardness is a value obtained by embedding the heat-treated coated powder in a resin, polishing the resin such that soft magnetic particles included in the heat-treated coated powder are exposed, and then performing the measurement on the exposed soft magnetic particles (the average of n=10). For each of samples Nos. 1-101 and 105 described later, the Vickers hardness of the powder was also measured in the same manner. These results are also shown in Table 2.

As shown in Table 2, the Vickers hardness decreases (the powder becomes softer) as the powder heat treatment temperature increases.

(Analysis of Composition of Insulating Layer and Composition of Insulating Pieces)

For each of samples Nos. 1-1, 1-2, and 1-5, the composition of the insulating layer in the heat-treated coated powder was analyzed. The results are shown in Table 2. The composition can be analyzed by EDX measurement on a cross section of a compact using a TEM. The analysis was performed at 10 or more points, and the average was used as the composition of the coating layer. The composition analysis was also performed similarly on the insulating layer and the insulating pieces in each of the dust cores in samples Nos. 1-1, 1-2, and 1-5 after the compact heat treatment step. The composition analysis was also performed similarly on the powder and the insulating layer of the dust core in each of samples Nos. 1-101 and 105 described later. These results are also shown in Table 2. For the insulating pieces, only the content of iron is shown.

As shown in Table 2, the content of phosphorus (P) in the insulating layer was almost unchanged irrespective of whether the powder heat treatment was performed and regardless of the temperature of the powder heat treatment. The content of phosphorus (P) was almost unchanged before and after the compact heat treatment. The higher the powder heat treatment temperature, the larger the content of iron (Fe) in the insulating layer, and the lower the content of oxygen (O). Therefore, it can be considered that during the powder heat treatment, diffusion of iron from the soft magnetic particles causes the content of iron in the insulating layer to increase and oxygen leaves the insulating layer. The content of iron (Fe) in the insulating layer was larger after the compact heat treatment than before, and the content of oxygen (O) was smaller after the compact heat treatment than before. This shows that, also during the compact heat treatment, iron diffuses from the soft magnetic particles and oxygen leaves the insulating layer. However, the content of iron (Fe) in the insulating pieces was almost the same as the content of iron in the insulating layer in the heat-treated coated powder. This may be because, since the insulating pieces have been separated from the soft magnetic particles in the compact heat treatment step, the insulating pieces are almost not influenced by the diffusion of iron from the soft magnetic particles. When the total content of P, Fe, and O is less than 100 atom % (samples other than sample No. 1-101), the balance is unavoidable impurities.

[Mixing Step]

One of the heat-treated coated powders in samples Nos. 1-1 to 1-5 and ethylene bis-stearic acid amide (EBS) serving as a lubricant were mixed to prepare a material mixture. The content of the lubricant was 0.05% by mass. The content of the lubricant is a value when the total amount of the heat-treated coated powder and the lubricant is taken as 1.00% by mass.

[Molding Step]

The material mixture was charged into a molding die and subjected to compression molding to prepare a ring-shaped compact having an outer diameter of 34 mm, an inner diameter of 20 mm, and a thickness of 5 mm. An aliphatic acid-based lubricant was applied to portions of the die to be in contact with the material mixture. The compression molding was performed in an air atmosphere at a molding pressure of 1,373 MPa (14 ton/cm$^2$) while the die was heated to 100° C.

[Compact Heat Treatment Step]

The compact was subjected to heat treatment to produce a dust core. The heat treatment was performed by heating the compact to 650° C. in a nitrogen atmosphere at a heating rate of 5° C./minutes, and the temperature was maintained for 15 minutes.

(Measurement of Size and Presence Ratio of Insulating Pieces)

After the compact heat treatment step, the size of the insulating pieces in each of the dust cores in samples Nos. 1-1, 1-2, and 1-5 and the presence ratio of the insulating pieces were measured. The results are shown in Table 2. The analysis of the size etc. of the insulating pieces in the dust core was performed similarly also for each of samples Nos. 1-101 and 105 described later. These results are also shown in Table 2.

<Size>

The size (μm) of an insulating piece was determined by measuring the longitudinal length of a strip-shaped piece observed in an image of a cross section of the dust core under an SEM. Specifically, the number of observation fields was 50, and the magnification was set to 5,000×. At least 100 regions which were surrounded by at least three mutually adjacent soft magnetic particles and in which an insulating piece was present were observed, and the average of the lengths of strip-shaped insulating pieces present in the above regions was used as the size of the insulating pieces.

<Presence Ratio>

The presence ratio (%) of the insulating pieces was determined using an observation image of a cross section of the dust core under an SEM. Specifically, the number of observation fields was 50, and the magnification was set to 5,000×. At least 100 regions surrounded by at least three mutually adjacent soft magnetic particles were observed, and the ratio of regions in which an insulating piece was present was used as the presence ratio.

As shown in Table 2, in samples Nos. 1-1, 1-2, and 1-5, the length of the insulating pieces was from 0.3 μm to 5.0 μm inclusive, and the presence ratio was from 5% to 90% inclusive. As can be seen, when the powder heat treatment is performed, insulating pieces peeled off and separated from the insulating layer are more likely to be formed during the compression molding. Moreover, the higher the powder heat treatment temperature, the longer the insulating pieces, and the larger the presence ratio.

[Samples Nos. 1-6 and 1-7]

Samples Nos. 1-6 and 1-7 were produced in the same manner as that for sample No. 1-1 except that the temperature of the die in the molding step was changed to 130° C. and room temperature, respectively.

[Samples Nos. 1-8 to 140]

Samples Nos. 1-8 to 1-10 were produced in the same manner as that for sample No, 1-1 except for the following.

Sample No. 1-8: In the mixing step, the material of the lubricant was changed to stearate (Li-st), and its content was set to 0.02% by mass. In the molding step, the temperature of the die was changed to 130° C.

Sample No. 1-9: In the mixing step, the material of the lubricant was changed to zinc stearate (Zn-st), and its content was set to 0.02% by mass. In the molding step, the temperature of the die was changed to 130° C.

Sample No. 1-40: In the mixing step, the material of the lubricant was changed to stearic acid amide (SA), and its content was set to 0.05% by mass. In the molding step, the temperature of the die was changed to 80° C.

[Sample No. 1-11]

Sample No. 1-11 was produced in the same manner as that for sample No. 1-1 except that no outer layer was formed and the insulating layer was composed only of the coating layer, that the heat treatment temperature in the powder heat treatment step was changed to 400° C., and that the heat treatment temperature in the compact heat treatment step was changed to 425° C.

[Samples Nos. 1-12 to 1-14]

Samples Nos. 1-12 to 1-14 were produced in the same manner as that for sample No. 1-1 except that an outer layer composed mainly of Mg—O (magnesium oxide), Al—O (aluminum oxide), or Ti—O (titanium oxide) was formed. The outer layer was formed, for example, by spraying a solution containing the hydrate of the oxides onto the soft magnetic particles while the soft magnetic particles were stirred using, for example, a mixer or rolled in a rotating container, mixing the solution and the soft magnetic particles, and then drying the resulting soft magnetic particles.

[Sample No. 1-101]

Sample No. 1-101 was produced in the same manner as that for sample No. 1-1 except that the powder heat treatment step was not performed.

[Samples Nos. 1-102 and 1-103]

Samples Nos. 1-102 and 1-103 were produced in the same manner as that for sample No. 1-101 except that, in the molding step, the temperature of the die was changed to 80° C. and room temperature, respectively. Specifically, the powder heat treatment step was not performed for samples Nos. 1-102 and 1-103.

[Samples Nos. 1-104 and 1-105]

Samples Nos. 1-104 and 1-105 were produced in the same manner as that for sample No. 1-1 except that, in the powder heat treatment step, the heat treatment temperature was changed to 350° C. and 700° C., respectively.

[Sample No. 1-106]

Sample No. 1-106 was produced in the same manner as that for sample No. 1-101 except that the material of the lubricant was changed to stearic acid amide (SA), that its content was set to 0.05% by mass, and that, in the molding step, the temperature of the die was changed to 80° C. Specifically, the powder heat treatment step was not performed for sample No. 1-106.

[Sample No. 1-107]

Sample No. 1-107 was produced in the same manner as that for sample No. 1-101 except that no outer layer was formed and the insulating layer was composed only of the coating layer and that the heat treatment temperature in the compact heat treatment step was changed to 425° C. Specifically, the powder heat treatment step was not performed for sample No. 1-107.

[Samples Nos. 1-108 to 1-110]

Samples Nos. 1-108 to 1-110 were produced in the same manner as that for sample No. 1-101 except that an outer layer composed mainly of Mg—O (magnesium oxide), Al—O (aluminum oxide), or Ti—O (titanium oxide) was formed. The outer layer was formed in the same manner as that for samples Nos. 1-12 to 1-14.

TABLE 1

| Sample No. | Preparation step Coated soft magnetic particles Insulating layer Coating layer | Outer layer | Powder heat treatment step Temperature (° C.) | Mixing step Lubricant Material | Content (% by mass) | Molding Step Temperature (° C.) | Compact heat treatment step Temperature (° C.) |
|---|---|---|---|---|---|---|---|
| 1-1 | Iron phosphate | Si—O | 500 | EBS | 0.05 | 100 | 650 |
| 1-2 | Iron phosphate | Si—O | 400 | EBS | 0.05 | 100 | 650 |
| 1-3 | Iron phosphate | Si—O | 450 | EBS | 0.05 | 100 | 650 |
| 1-4 | Iron phosphate | Si—O | 600 | EBS | 0.05 | 100 | 650 |
| 1-5 | Iron phosphate | Si—O | 650 | EBS | 0.05 | 100 | 650 |
| 1-6 | Iron phosphate | Si—O | 500 | EBS | 0.05 | 130 | 650 |
| 1-7 | Iron phosphate | Si—O | 500 | EBS | 0.05 | Room Temperature | 650 |
| 1-8 | Iron phosphate | Si—O | 500 | Li-st | 0.02 | 130 | 650 |
| 1-9 | Iron phosphate | Si—O | 500 | Zn-st | 0.02 | 130 | 650 |
| 1-10 | Iron phosphate | Si—O | 500 | SA | 0.05 | 80 | 650 |
| 1-11 | Iron phosphate | — | 400 | EBS | 0.05 | 100 | 425 |
| 1-12 | Iron phosphate | Mg—O | 500 | EBS | 0.05 | 100 | 650 |
| 1-13 | Iron phosphate | Al—O | 500 | EBS | 0.05 | 100 | 650 |
| 1-14 | Iron phosphate | Ti—O | 500 | EBS | 0.05 | 100 | 650 |
| 1-101 | Iron phosphate | Si—O | — | EBS | 0.05 | 100 | 650 |
| 1-102 | Iron phosphate | Si—O | — | EBS | 0.05 | 80 | 650 |
| 1-103 | Iron phosphate | Si—O | — | EBS | 0.05 | Room Temperature | 650 |
| 1-104 | Iron phosphate | Si—O | 350 | EBS | 0.05 | 100 | 650 |
| 1-105 | Iron phosphate | Si—O | 700 | EBS | 0.05 | 100 | 650 |
| 1-106 | Iron phosphate | Si—O | — | SA | 0.05 | 80 | 650 |
| 1-107 | Iron phosphate | — | — | EBS | 0.05 | 100 | 425 |
| 1-108 | Iron phosphate | Mg—O | — | EBS | 0.05 | 100 | 650 |
| 1-109 | Iron phosphate | Al—O | — | EBS | 0.05 | 100 | 650 |
| 1-110 | Iron phosphate | Ti—O | — | EBS | 0.05 | 100 | 650 |

TABLE 2

| Sample No. | Powder heat treatment step Temperature (° C.) | Vickers hardness (HV) | Hear-treated coated powder P (atom %) | Fe (atom %) | O (atom %) | Compact heat treatment step Temperature (° C.) | Dust core Insulating layer P (atom %) | Fe (atom %) | O (atam %) | Insulating piece Fe (atom %) | Length (μm) | Presence ratio (%) |
|---|---|---|---|---|---|---|---|---|---|---|---|---|
| 1-1 | 500 | 112 | 11.0 | 28.0 | 60.1 | 650 | 11.2 | 32.4 | 56.3 | 28.2 | 2.4 | 63 |
| 1-2 | 400 | 119 | 12.8 | 24.6 | 61.5 | 650 | 12.4 | 27.8 | 58.4 | 25.3 | 0.7 | 12 |
| 1-5 | 650 | 82 | 11.2 | 34.2 | 54.0 | 650 | 10.9 | 37.6 | 50.9 | 34.7 | 4.3 | 82 |
| 1-101 | — | 130 | 13.0 | 18.6 | 68.4 | 650 | 12.8 | 23.6 | 63.6 | 19.0 | 0.1 | 2 |
| 1-105 | 700 | 80 | 13.6 | 39.8 | 46.1 | 650 | 12.4 | 47.0 | 40.5 | 40.2 | 7.2 | 96 |

[Density]

The density (g/cm$^3$) of each sample was measured. The results are shown in Table 3. The density was measured using the Archimedes method.

[Electrical Resistivity]

The electrical resistivity (Ω·cm) of each sample was measured. The results are shown in Table 3. The electrical resistivity was measured as follows. A cross section of the sample was taken, and measurement was performed on the cross section by a DC four probe method using a low resistivity meter Loresta GP (type MCP-T610 manufactured by Mitsubishi Chemical Analytech Co., Ltd.).

[Magnetic Properties]

The magnetic properties of each sample were measured using the following procedure. A copper wire was wound around the ring-shaped sample to prepare a measurement component including a 300-turn primary coil and a 20-turn secondary coil. The measurement component and an AC-BH curve tracer (BHU-60 manufactured by Riken Denshi Ltd.) were used to determine a core loss (hysteresis loss+eddy-current loss) at an excitation magnetic flux density Bm of 0.1 T and a measurement frequency of 10 kHz. The results for the core loss together with the results for the hysteresis loss and eddy-current loss are shown in Table 3.

TABLE 3

| Sample No. | Dust core Density (g/cm$^3$) | Electrical resistivity (Ω · cm) | Core loss (kW/m$^3$) | Hysteresis loss (kW/m$^3$) | Eddy-current loss (kW/m$^3$) |
|---|---|---|---|---|---|
| 1-1 | 7.588 | $2.1 \times 10^1$ | 118.2 | 95.9 | 22.3 |
| 1-2 | 7.557 | $3.6 \times 10^1$ | 122.1 | 96.6 | 25.5 |
| 1-3 | 7.571 | $3.5 \times 10^1$ | 119.3 | 96.1 | 23.2 |

TABLE 3-continued

| Sample No. | Dust core Density (g/cm³) | Electrical resistivity (Ω · cm) | Core loss (kW/m³) | Hysteresis loss (kW/m³) | Eddy-current loss (kW/m³) |
|---|---|---|---|---|---|
| 1-4 | 7.610 | $1.1 \times 10^{1}$ | 118.5 | 95.1 | 23.4 |
| 1-5 | 7.642 | $1.3 \times 10^{0}$ | 121.6 | 92.1 | 29.5 |
| 1-6 | 7.599 | $2.2 \times 10^{1}$ | 119.7 | 94.9 | 24.8 |
| 1-7 | 7.522 | $3.2 \times 10^{1}$ | 123.5 | 97.9 | 25.6 |
| 1-8 | 7.605 | $7.5 \times 10^{1}$ | 115.0 | 92.5 | 22.5 |
| 1-9 | 7.624 | $3.1 \times 10^{1}$ | 114.3 | 91.0 | 23.3 |
| 1-10 | 7.568 | $6.7 \times 10^{0}$ | 118.8 | 95.8 | 23.0 |
| 1-11 | 7.683 | $4.4 \times 10^{0}$ | 188.2 | 163 | 25.2 |
| 1-12 | 7.578 | $2.8 \times 10^{1}$ | 119.1 | 96.5 | 22.6 |
| 1-13 | 7.567 | $6.8 \times 10^{1}$ | 120.3 | 96.8 | 23.5 |
| 1-14 | 7.581 | $1.7 \times 10^{1}$ | 118.5 | 96.4 | 22.1 |
| 1-101 | 7.532 | $2.7 \times 10^{-1}$ | 153.2 | 97.3 | 55.9 |
| 1-102 | 7.498 | $4.6 \times 10^{-1}$ | 128.7 | 98.7 | 30.0 |
| 1-103 | 7.412 | $3.2 \times 10^{3}$ | 131.5 | 103.9 | 27.6 |
| 1-104 | 7.536 | $4.1 \times 10^{-1}$ | 134.3 | 97.5 | 36.8 |
| 1-105 | 7.671 | $0.8 \times 10^{-2}$ | 681.2 | 94.2 | 587.0 |
| 1-106 | 7.517 | $0.6 \times 10^{-2}$ | 351.1 | 98.7 | 252.4 |
| 1-107 | 7.644 | $8.9 \times 10^{-4}$ | 727.7 | 169.8 | 557.9 |
| 1-108 | 7.523 | $3.5 \times 10^{-1}$ | 132.0 | 98.4 | 33.6 |
| 1-109 | 7.528 | $4.1 \times 10^{-1}$ | 129.9 | 98.8 | 31.1 |
| 1-110 | 7.531 | $3.2 \times 10^{-1}$ | 133.2 | 98.5 | 34.7 |

As shown in Table 3, in samples Nos. 1-1 to 1-14, the density was 7.5 g/cm³ or more, and the eddy-current loss was 30 kW/m³ or less, so that high density and low loss were achieved simultaneously. Samples Nos. 1-101 to 1-110 satisfy only one of a density of 7.5 g/cm³ or more and an eddy-current loss of 30 kW/m³ or lower.

Samples Nos. 1-1 to 1-5 combine high density with low loss are higher in density and lower in loss than samples Nos. 1-101 and 1-102. The reason that samples Nos. 1-1 to 1-5 are higher in density may be that, as a result of the removal of the strain in the coated soft magnetic powder in the powder heat treatment step, the coated soft magnetic powder is softened. The reason that samples Nos. 1-1 to 1-5 are lower in loss may be that, the eddy-current loss, in particular, can be reduced. This may be because of the following reason. As a result of the heat treatment performed on the coated soft magnetic powder, the insulating layer (iron phosphate) having an amorphous structure before the heat treatment is partially crystallized and is thereby embrittled, so that breakage of the insulating layer in the molding step is prevented. As can be seen from the comparison between samples Nos. 1-1 to 1-5 and samples Nos. 1-101 and 1-102, when the coated soft magnetic powder is subjected to heat treatment, the eddy-current loss can be reduced even when the compression molding is performed while the die is heated to high temperature.

As can be seen from the comparison between samples Nos. 1-1 to 1-5, 1-104, and 1-105, the higher the powder heat treatment temperature, the higher the density, and the lower the hysteresis loss. This is because as the powder heat treatment temperature increases, the degree of removal of the strain in the soft magnetic powder increases, and softening of the soft magnetic powder due to the removal of the strain proceeds. In samples Nos. 1-1 to 1-5 among samples Nos. 1-1 to 1-5, 1-104, and 1-105, the powder heat treatment temperature was from 400° C. to 650° C. inclusive, and the eddy-current loss could be reduced. In particular, in samples Nos. 1-1, 1-3, and 1-4, the powder heat treatment temperature was from 450° C. to 600° C. inclusive, and the eddy-current loss could be particularly reduced. In sample. No. 1-104, the powder heat treatment temperature was 350° C. In this case, it may be considered that the effect of reducing the pressure on the non-peeled insulating layer through the insulating pieces was not sufficiently obtained. Therefore, in sample No. 1-104, breakage of the insulating layer during the compression molding may not be prevented. In this case, the soft magnetic particles are exposed from the insulating layer, and the exposed particles are in contact with each other. In sample No. 1-105, the powder heat treatment temperature was 700° C., and the insulating layer was completely crystallized. In this case, it may be considered that (1) the electrical resistivity was reduced significantly and the particles were electrically connected, and (2) during the compression molding, the insulating layer was peeled off to the extent that the surface of the soft magnetic particles was exposed, so that the insulation between the soft magnetic particle could not be improved.

Sample No. 1-6 is higher in density than sample No. 1-1 but is higher in loss. The reason that sample No. 1-6 is higher in density may be that, since the molding temperature is higher, the yield stress of the heat-treated coated powder decreases and the heat-treated coated powder is easily deformable. The hysteresis loss is lower in sample No. 1-6 than in sample No. 1-1, but the eddy-current loss is higher in sample No. 1-6. The low hysteresis loss and the high eddy-current loss may be due to the high molding temperature. Since the molding temperature is high, the strain in the soft magnetic particles can be reduced, so that the hysteresis loss can be reduced. However, the soft magnetic particles are easily deformable. Therefore, as the impact acting on the insulating film increases, the number of broken portions of the insulating layer increases. This may cause the eddy-current loss to increase.

Samples Nos. 1-8 and 1-9 are higher in density and lower in loss than samples Nos. 1-1 and 1-6. One reason that samples Nos. 1-8 and 1-9 are higher in density is the same as that for sample No. 1-6. Another reason may be that the material of the lubricant is different and its content is smaller. The reason that samples Nos. 1-8 and 1-9 are lower in loss is that the hysteresis loss, in particular, can be reduced. The reasons that the core loss can be reduced in samples Nos. 1-8 and 1-9 although the content of the lubricant is lower and the molding temperature is higher may be as follows. In sample No. 1-8, the reason may be that, since the melting point of lithium stearate is higher than that of ethylene bis-stearic acid amide, the degree of breakage of the insulating layer is lower than that in samples Nos. 1-1 and 1-6. In sample No. 1-9, the reason may be that the dynamic frictional force of zinc stearate is smaller than that of ethylene bis-stearic acid amide.

Sample No. 1-7 is higher in density and lower in loss than sample No. 1-103. The reason that sample No. 1-7 is higher in density and lower in loss may be the same as that for sample No. 1-1 described above. As can be seen from the comparison between samples Nos. 1-7 and 1-103, even when the molding temperature is room temperature at which high density is generally difficult to achieve, high density can be achieved by the powder heat treatment. As described above, the same effect can be obtained by the powder heat treatment irrespective of the molding temperature.

Sample No. 1-10 is higher in density and lower in loss than samples Nos. 1-102 and 1-106. The reason that sample No. 1-10 is higher in density and lower in loss may be the same as that for sample No. 1-1 described above. Although an appropriate molding temperature varies depending on the type of lubricant added, the same effect can be obtained by the powder heat treatment.

Sample No. 1-11 is higher in density and lower in loss than sample No. 1-107. The reason that sample No. 1-11 is higher in density and lower in loss may be the same as that for sample No. 1-1 described above.

Samples Nos. 1-12 to 1-14 have high density and low loss comparable to those of sample No. 1-1 and are higher in density and lower in loss than samples Nos. 1-108 to 1-110. The reason that samples Nos. 1-12 to 1-14 are higher in density and lower in loss than samples Nos. 1-108 to 1-110 may be the same as that for sample No. 1-1. As described above, when the outer layer is composed mainly of any of Si—O, Mg—O, Al—O, and Ti—O, a dust core with high density and low loss can be obtained.

As can be seen from the above results, by subjecting the coated soft magnetic powder to heat treatment, the insulating layer is partially crystalized and embrittled. In this case, although the insulating layer is easily peeled off to an appropriate extent but is substantially prevented from peeling off to the extent that the soft magnetic particles are exposed. Therefore, even when room temperature molding by which high density is difficult to achieve is performed or when molding under heating by which low loss is difficult to achieve is performed, breakage of the insulating layer can be prevented, and a high-density dust core is obtained. In addition, an increase in eddy-current loss can be prevented, and therefore the dust core obtained has low-core loss.

[Observation of Cross Section]

For each of samples Nos. 1-1 and 1-101, regions surrounded by at least three soft magnetic particles were observed under a TEM. In this case, 20 or more observation fields were observed. In sample No. 1-1, insulating pieces were observed in all the regions (see, for example, FIG. 1). However, in sample No. 1-101, no insulating pieces were observed in any regions.

[Analysis of Composition and Structure]

The composition of the insulating pieces in sample No. 1-1 was analyzed by the same method as that for analyzing the composition of the insulating layer in Test Example 1. The insulating pieces were found to be composed of the same materials as the constituent materials of the insulating layer. The structure of the insulating pieces was analyzed by TEM observation and found to be crystallized.

As can be seen from the above results, by using the heat-treated coated powder prepared by subjecting the coated soft magnetic powder to heat treatment, a dust core that combines high density with low loss can be manufactured. In the dust core that combines high density with low loss, insulating pieces are present in regions surrounded by at least three soft magnetic particles. In other words, a dust core in which insulating pieces are present in the above-described regions combines high density with low loss.

Test Example 2

In Test Example 2, dust core samples Nos. 2-1 to 2-11 were produced, and the density and magnetic properties of each sample were evaluated. The results are shown in Table 4. Sample No. 2-1 is the same as sample No. 1-1 in Test Example 1. Samples Nos. 2-2 to 2-11 were produced in the same manner as that for sample No. 1-1 except that the thicknesses of the insulating layer (the coating layer and the outer layer) were changed.

TABLE 4

| | Dust core | | | | | |
|---|---|---|---|---|---|---|
| | Insulating layer Thickness (nm) | | | Core | Hysteresis | Eddy-current |
| Sample No. | Coating layer | Outer layer | Density (g/cm$^3$) | loss (kW/m$^3$) | loss (kW/m$^3$) | loss (kW/m$^3$) |
| 2-1 | 102 | 31 | 7.588 | 118.2 | 95.9 | 22.3 |
| 2-2 | 14 | 33 | 7.651 | 132.1 | 91.1 | 41 |
| 2-3 | 35 | 32 | 7.632 | 121.8 | 92.7 | 29.1 |
| 2-4 | 63 | 33 | 7.611 | 118.9 | 93.2 | 25.7 |
| 2-5 | 118 | 30 | 7.524 | 120.3 | 98.1 | 22.2 |
| 2-6 | 142 | 32 | 7.471 | 126.7 | 104.2 | 22.5 |
| 2-7 | 103 | 4 | 7.628 | 143.8 | 93.4 | 50.4 |
| 2-8 | 97 | 12 | 7.606 | 122.1 | 93.9 | 28.2 |
| 2-9 | 99 | 64 | 7.545 | 119.4 | 97.6 | 21.8 |
| 2-10 | 104 | 94 | 7.504 | 120.4 | 98.8 | 21.6 |
| 2-11 | 93 | 113 | 7.477 | 126.1 | 103.6 | 22.5 |

As shown in Table 4, in samples Nos. 2-1, 2-3 to 2-5, and 2-8 to 2-10 in which the thickness of the coating layer was from 30 nm to 120 nm inclusive and the thickness of the outer layer was from 10 nm to 100 nm inclusive, the density was 7.5 g/cm$^3$ or more, and the eddy-current loss was 30 kW/m$^3$ or less. These samples combine high density with low loss. However, in sample No. 2-2 in which the thickness of the outer layer was from 10 am to 100 nm inclusive but the thickness of the coating layer was 14 nm, the eddy-current loss (core loss) was large. In sample No. 2-6 in which the thickness of the coating layer was 142 nm, the density was low. In sample No. 2-7 in which the thickness of the coating layer was from 30 nm to 120 nm inclusive but the thickness of the outer layer was 4 DM, the eddy-current loss (core loss) was large. In sample No. 2-11 in which the thickness of the outer layer was 113 nm, the density was low. These results show the following. When the thickness of the insulating layer is excessively small, the insulation between the particles cannot be improved, so that the eddy-current loss increases. When the thickness of the insulating layer is excessively large, the distances between the particles increase. In addition, since the powder is not easily deformable, the density cannot be increased.

REFERENCE SIGNS LIST

1 dust core
2 soft magnetic particles
3 insulating layer
31 coating layer, 32 outer layer
4 insulating piece
100 coil component
10 magnetic core
20 coil, 20*w* wire

The invention claimed is:

1. A dust core comprising:

a plurality of soft magnetic particles composed of an iron-based material;

an insulating layer including a coating layer that is composed mainly of a phosphate and covers the surface of the soft magnetic particles; and insulating pieces containing a constituent material of the insulating layer, each of the insulating pieces being surrounded by at least three mutually adjacent ones of the soft magnetic particles while separated from the insulating layer, wherein the insulating pieces are substantially completely crystalized.

2. The dust core according to claim 1, wherein the insulating pieces are composed mainly of iron phosphate containing iron in an amount of from 20 atom % to 37 atom % inclusive.

3. The dust core according to claim 1, wherein the coating layer has an average thickness of from 30 nm to 120 nm inclusive.

4. The dust core according to claim 1, wherein the insulating layer further includes an outer layer formed outward of the coating layer, and wherein the outer layer is composed mainly of O and one element selected from Si, Mg, Ti, and Al.

5. The dust core according to claim 4, wherein the outer layer has an average thickness of from 10 nm to 100 nm inclusive.

6. The dust core according to claim 1, wherein the material of the soft magnetic particles is pure iron.

7. The dust core according to claim 1, wherein the coating layer is composed mainly of iron phosphate containing iron in an amount of from 22 atom % to 40 atom % inclusive.

8. The dust core according to claim 1, wherein an inner portion of the dust core has an electrical resistivity of $5\times10^{-1}$ Ω·cm or more.

9. An electromagnetic component comprising: a coil formed by winding a wire; and a magnetic core around which the coil is disposed, wherein at least part of the magnetic core is the dust core according to claim 1.

10. The dust core according to claim 1, wherein the soft magnetic particles are not exposed from the insulating layer.

* * * * *